US005398902A

United States Patent [19]

Crowe

[11] Patent Number: 5,398,902

[45] Date of Patent: Mar. 21, 1995

[54] BARN DOOR FLASHING BRACKET ASSEMBLY

[76] Inventor: Roger K. Crowe, 3041 W. County Rd. 100 South, New Castle, Ind. 47362

[21] Appl. No.: 950,112

[22] Filed: Sep. 23, 1992

[51] Int. Cl.[6] ..... E05D 13/00

[52] U.S. Cl. ..... 248/300; 16/94 R; 16/95 R

[58] Field of Search ..... 248/300, 251; 16/94 R, 16/95 R

[56] References Cited

U.S. PATENT DOCUMENTS

| | | | |
|---|---|---|---|
| D. 162,122 | 2/1951 | Broeren | 248/300 |
| 1,787,734 | 1/1931 | Rowling | 248/300 |
| 3,636,588 | 1/1972 | Ferris | 16/94 |
| 3,983,600 | 10/1976 | Smith | 16/94 R |
| 4,081,880 | 4/1978 | Edeus | 16/90 |
| 4,424,605 | 1/1984 | Squires et al. | 16/94 |
| 4,494,354 | 1/1985 | Johnston | 52/814 |
| 4,642,844 | 2/1987 | Johnston | 16/98 |
| 4,845,807 | 7/1989 | Rooney | 16/94 |
| 5,035,025 | 7/1991 | Morris et al. | 16/97 |
| 5,186,426 | 2/1993 | Wada | 16/94 R |

*Primary Examiner*—Eugenia Jones
*Assistant Examiner*—Allan M. Schrock
*Attorney, Agent, or Firm*—Conley, Rose & Tayon

[57] ABSTRACT

A bracket assembly for supporting a sliding door track and a flashing on a structure is disclosed, comprising a mounting bracket including a substantially flat first section and a substantially flat second section affixed to and extending from the first section, the second section forming parallel opposed U-shaped channels extending upwardly and inwardly from the second section and spaced a first distance apart, and a flashing bracket adapted to support a flashing thereon and including an attachment end having a pair of engagement portions adapted to be received in the channels.

8 Claims, 2 Drawing Sheets

BARN DOOR FLASHING BRACKET ASSEMBLY

TECHNICAL FIELD OF THE INVENTION

The present invention relates in general to mounting brackets for supporting a protective cover over the hardware for hanging a sliding door. More particularly, the present invention discloses a snap-in flashing bracket which is easily installed over the sliding door and easily removed therefrom, and which supports the protective cover without the use of additional fasteners.

BACKGROUND OF THE INVENTION

Commonly, large doors, such as for barns, aircraft hangers and other large structures, are slidably mounted rather than hinged. A mounting structure for such sliding doors typically comprises a support track horizontally mounted on the wall or frame of the barn and a plurality of rollers mounted therein, from which the door depends.

In addition, it is frequently desired to provide a cover or flashing over the track assembly, in order to protect it from the elements and to provide a more aesthetic appearance for the structure. To this end, various assemblies for mounting and/or supporting the flashing have been developed. In one version, the flashing is an extension of and integral with the support track. In other systems, the flashing is mounted on flashing brackets which are, in turn, mounted on the hardware which supports the track assembly.

U.S. Pat. No. 4,424,605 discloses a support track mounting bracket having its center portion offset from the support track and having an opening in that offset portion. A flashing bracket is provided with a tab that fits in the space between the offset portion and the support track and is held in place by a detent which protrudes from the tab and engages the hole in the offset portion. Once the flashing brackets have been installed they are permanently locked to the support track mounting brackets by the detent.

U.S. Pat. No. 4,845,807 discloses a flashing bracket provided with a dependent hook portion at its upper edge and having an upwardly extending resilient tongue extending from a perpendicular intermediate portion. The tongue is biased away from the plane of the intermediate portion. The flashing bracket requires a mounting bracket that includes a slot for receiving the hook. The flashing bracket is installed on the mounting bracket by pivoting the flashing bracket downward so that the hook engages the corresponding slot in the mounting bracket and the tongue snaps under the forward edge of the mounting bracket, locking the two brackets together. A disadvantage of the flashing bracket of the '807 patent is that it is necessary to displace the tongue outward and free it from engagement with the forward edge of the mounting bracket in order to remove the flashing bracket.

The present invention discloses a flashing bracket which is easily mounted on the track assembly support bracket without the use of a hammer or other tools and which is also easily removed from the support bracket, again without the use of tools. Other objects and advantages of the invention will appear from the following description.

SUMMARY OF THE INVENTION

The flashing support assembly of the present invention comprises a track assembly mounting bracket provided with a pair of channels and a flashing bracket adapted to be received within the channels and to provide frictional engagement therewith. The present flashing bracket can be mounted in a few seconds by hand, and will effectively support a flashing. The present bracket can be removed and reused as desired. It is inexpensive to manufacture, easy to make and use, reliable, durable, and effective.

BRIEF DESCRIPTION OF THE DRAWINGS

For a detailed description of a preferred embodiment of the invention, reference will now be made to the accompanying drawings wherein.

DETAILED DESCRIPTION OF THE PREFERRED EMBODIMENT OF THE INVENTION

Figure 1:
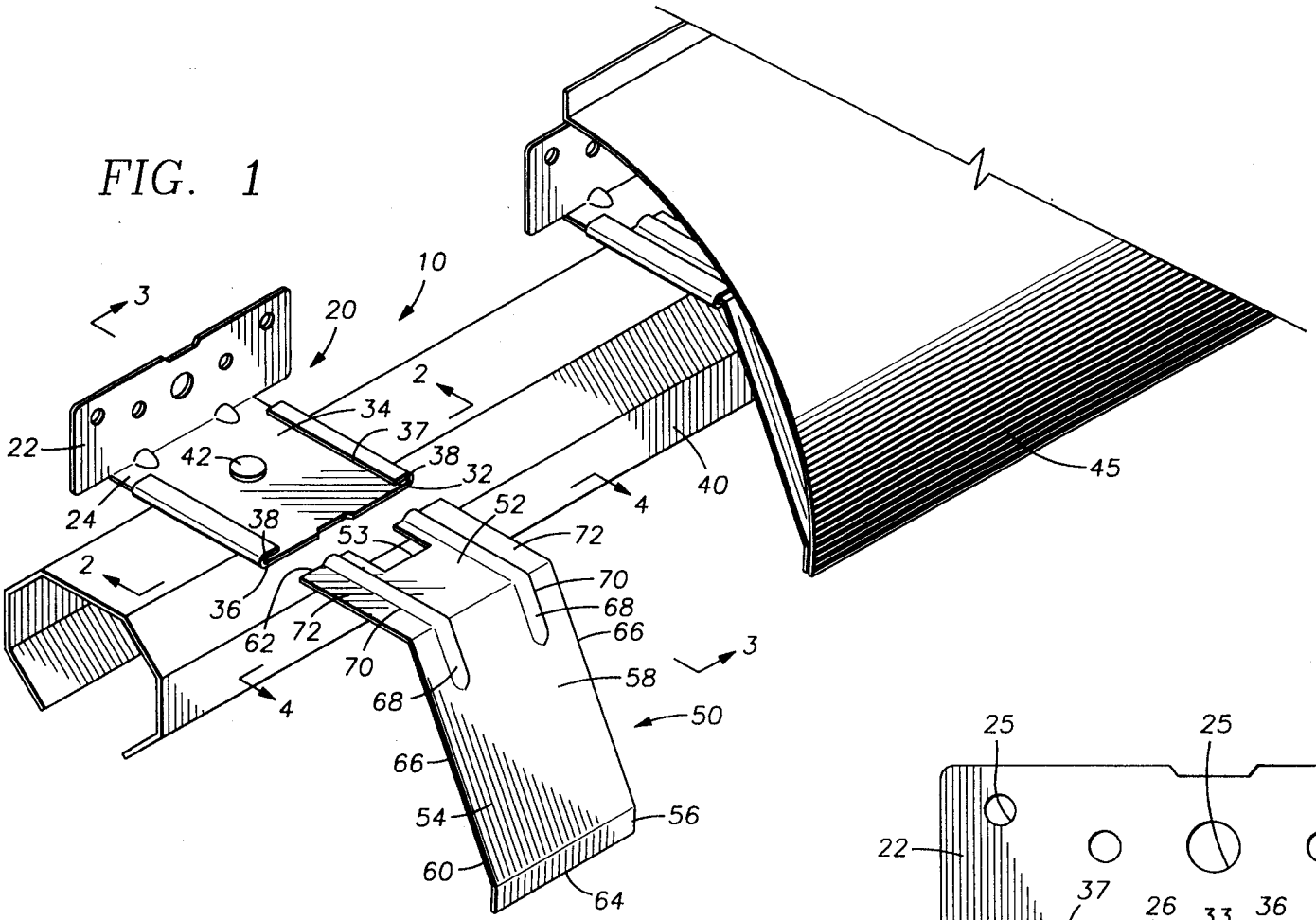
FIG. 1 is an isometric view of the flashing mounting assembly of the present invention in an unassembled position.

Referring initially to FIG. 1, the flashing mounting assembly 10 of the present invention comprises a track assembly mounting bracket 20 and a flashing bracket 50. Mounting bracket 20 is attached to and supports a portion of slide track 40 for supporting or hanging a sliding door, which attachment is well known in the art and is not an element of the present invention. A rivet 42 or other connecting means serves to hold track 40 on mounting bracket 20.

Figure 2:
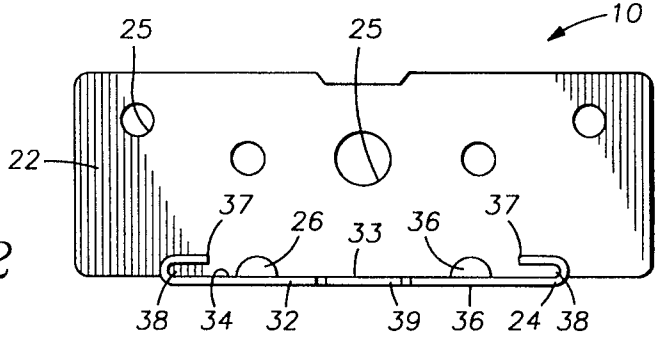
FIG. 2 is a front end view of the track assembly mounting bracket of the present invention, taken along a direction indicated by arrow "2" of FIG. 1.

Referring now to FIGS. 1 and 2, mounting bracket 20 comprises a substantially flat back plate 22, and a substantially flat guide plate 24 extending substantially perpendicularly therefrom. Preferably, back plate 22 includes a plurality of holes 25 therethrough, arrayed in a desired pattern, through which a desired attaching means (not shown) can be placed to affix the mounting bracket to the wall, siding, or door header of the barn or other structure. Between back plate 22 and guide plate 24 and spanning the angle therebetween are disposed a plurality of wedge-shaped supports 26 which may be integrally formed in and between the plates, or welded or otherwise affixed thereto.

Guide plate 24 is preferably substantially rectangular, with its rear edge integral with the lower edge of back plate 22. Guide plate 24 has a relatively straight forward edge 32 and relatively flat upper and lower surfaces 34, 36, respectively. Its two side edges 37 curve upwards and are bent toward each other, forming two substantially parallel, opposed U-shaped channels 38 and defining a body 39 therebetween. Body 39 is provided with one or more holes 33, for receiving rivet 42 or other fastening means for mounting support rail 40, as mentioned above.

Figure 3:
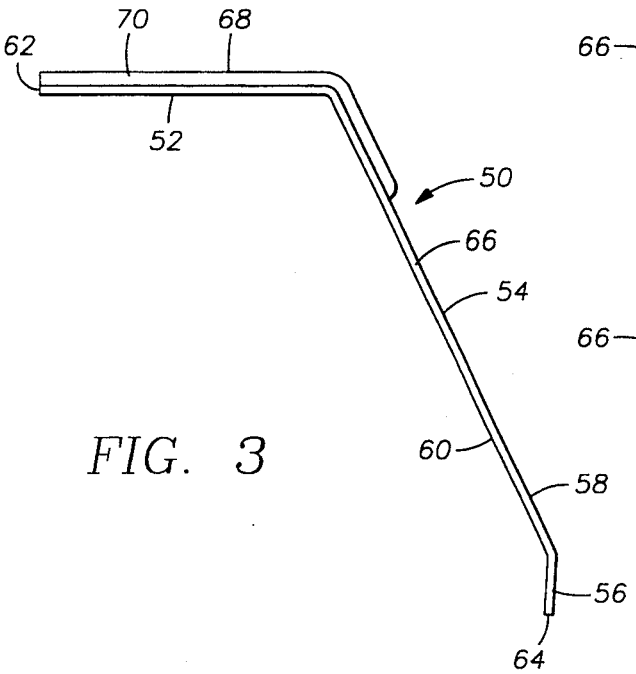
FIG. 3 is a side view of the flashing bracket of the present invention, taken in the direction of arrow "3" of FIG. 1.

Referring now to FIGS. 1 and 3, flashing bracket 50 comprises three substantially flat adjacent sections, namely an attachment section 52, an intermediate section 54, and a lower end section 56. Preferably, intermediate section 54 and end section 56 are integral with attachment section 52 and are each disposed at some desired angle with respect to attachment section 52, which angles allow a flashing member 45 to be supported thereon, as shown in FIG. 1. In the preferred embodiment, attachment section 52 includes a cut-out portion 53, which is sized to clear or straddle rivet 42. Flashing bracket 50 has an outer surface 58, an inner surface 60, an upper edge 62, a lower edge 64, and side edges 66.

Still referring to FIGS. 1 and 3, two embossments 68 extend across attachment section 52 from upper edge 62 on outer surface 58. Preferably, embossments 68 also extend partially down outer surface 58 of intermediate section 54 and provide mechanical support for the angle between attachment section 52 and intermediate section 54. Embossments 68 are substantially parallel to and laterally spaced from side edges 66. Preferably, embossments 68 have a height sufficient to allow engagement of embossments 68 with the undersides of U-shaped channels 38 and/or edges 37 of guide plate 24 when installed. Thus, embossments 68 assist in obtaining a friction fit of bracket 50 within guide slot 24 of bracket 20.

Figure 4A:
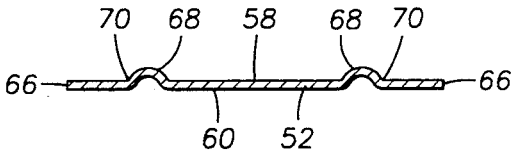
FIGS. 4*a*, 4*b*, and 4*c* are cross-sectional views of alternative embodiments of the flashing bracket of the present invention, taken along lines 4—4 of FIG. 1.
Figure 4B:
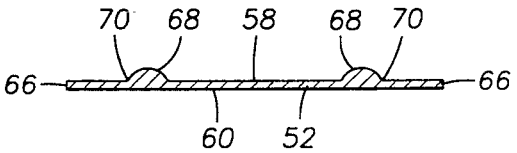
Figure 4C:
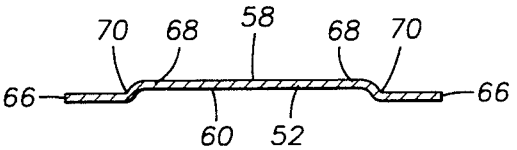

Embossments 68 are preferably embossed in section 52 as shown in FIG. 4*a*, but alternatively may be added to a substantially flat attachment section 52 as by welding, or formed integrally with attachment section 52, as shown in FIG. 4*b*. Alternatively, a single embossment 69 may be formed, as shown in FIG. 4*c*, having the same height and serving the same purpose as the dual embossments 68.

Embossments 68 have outer edges 70. It is preferred that the distance between outer edges 70 of embossments 68 be such as to effect an interference fit with U-shaped channels 38 in an inserted position. A pair of tongue sections 72 is formed by the portions of attachment section 52 extending beyond outer edges 70 of embossments 68. Tongue sections 72 of attachment section 52 are received within channels 38, and it is preferred that the width of tongue sections 72 be approximately equal to or slightly less than the depth of U-shaped channels 38.

Figure 5:
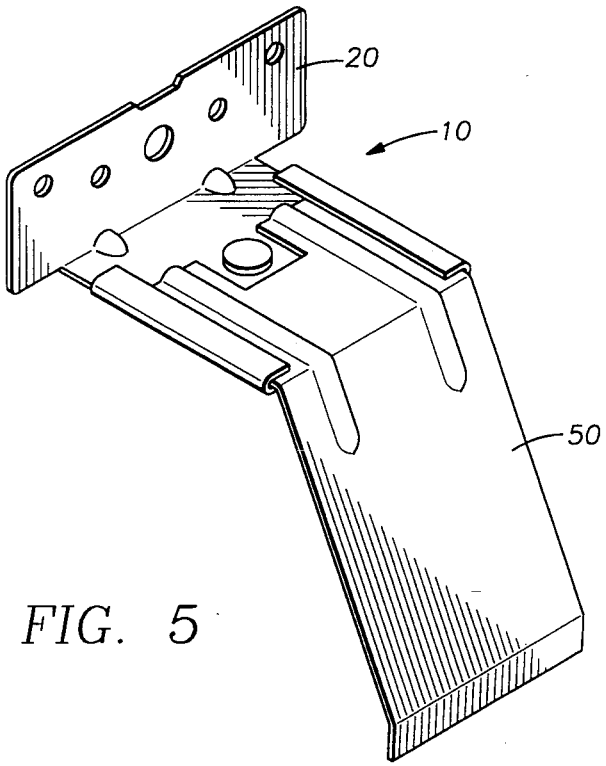
FIG. 5 is an isometric view of the flashing mounting assembly of the present invention in a nearly fully engaged position.

When it is desired to mount a flashing bracket 50 in support bracket 20, it is merely necessary to align tongue sections 72 of flashing bracket 50 with the U-shaped channels 38 of guide plate 24, as shown in FIG. 1, and insert flashing bracket 50 into mounting bracket 20 by pushing it inwardly on the guide plate, as shown in FIG. 5. Preferably, as indicated above, there will be some frictional interference between side edges 70 of embossments 68 and channels 38 of mounting bracket 20. According to the preferred embodiment, the interference fit will be capable of attainment by hand, or with simply light tapping with a hammer or similar tool. Channels 38 serve to guide flashing bracket 50 into place and to grip the sides of attachment section 52, thereby securing flashing bracket 50 to mounting bracket 20. Cut-out portion 53 allows attachment section 52 to clear rivet 42 without obstructing access thereto.

Once flashing bracket 50 is mounted on mounting bracket 20, the flashing member 45 can be installed and will rest on outer surface 58 thereof, as shown in FIG. 1. If for some reason it is desired to dismantle the flashing mounting assembly 10, flashing member 45 can be removed and flashing brackets 50 can simply be pulled out of mounting brackets 20 with a minimum of effort.

The flashing mounting bracket assembly of the present invention is preferably constructed of tin, galvanized steel, or other suitable rust-resistant metal, so that it has sufficient strength to support the track assembly and the sliding door suspended therefrom, and of course the flashing. Other materials may of course be used, provided they are appropriate to the present application.

While a preferred embodiment of the invention has been shown and described, modifications thereof can be made by one skilled in the art without departing from the spirit of the invention. For example, the embossments could be omitted, the configuration of the flashing bracket could be altered, the side edges of the guide plate could be brought together to enclose the channels, or the general shape of the mounting bracket could be altered. Accordingly, the scope of the invention should only be determined by reference to the following claims.

I claim:

1. A bracket assembly for supporting a sliding door track and a flashing on a structure, comprising:

a mounting bracket including a substantially flat mounting portion and a substantially flat attachment portion affixed to and extending from said mounting portion, said attachment portion having a front edge, a rear portion adjacent said mounting portion, and having substantially parallel opposing sides, each of said sides having a U-shaped channel therealong, said channels curving upwardly away from the sliding door track and opening inwardly toward one another, said channels being parallel and having upper inner edges;

means for securing said mounting portion to the structure;

means for attaching the sliding door track to said attachment portion; and a flashing bracket including means for supporting a flashing member thereon and an upper engagement portion having engagement means for insertion into said channels for retaining said flashing bracket in said mounting bracket.

2. The bracket assembly of claim 1 wherein said engagement portion is adapted to clear said attachment means when inserted into said attachment portion.

3. The bracket assembly of claim 1 wherein said engagement portion further includes an embossment means disposed thereon to frictionally engage one of said channels, such that said flashing bracket is releasable from a fully engaged position within said channels upon movement of said flashing bracket in a direction parallel to said channels.

4. The bracket assembly of claim 3, including a second embossment means disposed on said engagement portion to frictionally engage the other of said channels.

5. The bracket assembly of claim 3 wherein said embossment means has outer side edges that are spaced apart a distance which is slightly greater than the distance between said upper inner edges of said channels.

6. The bracket assembly of claim 1 wherein said mounting portion of said mounting bracket is integral with said attachment portion.

7. The bracket assembly of claim 1 further including at least one support member joining said mounting portion to said attachment portion.

8. The bracket assembly of claim 3 wherein said channels are integral with said sides of said attachment portion.

* * * * *